US010694291B2

(12) United States Patent
Zhang

(10) Patent No.: US 10,694,291 B2
(45) Date of Patent: Jun. 23, 2020

(54) DIRECTIONAL PROPAGATION METHOD AND APPARATUS FOR AUDIO SIGNAL, A TERMINAL DEVICE AND A STORAGE MEDIUM

(71) Applicant: YULONG COMPUTER TELECOMMUNICATION SCIENTIFIC (SHENZHEN) CO., LTD. (CN), Shenzhen, Guangdong (CN)

(72) Inventor: Zijing Zhang, Shenzhen (CN)

(73) Assignee: YULONG COMPUTER TELECOMMUNICATION SCIENTIFIC (SHENZHEN) CO., LTD. (CN), Shenzhen (CN)

( * ) Notice: Subject to any disclaimer, the term of this patent is extended or adjusted under 35 U.S.C. 154(b) by 6 days.

(21) Appl. No.: 16/049,704

(22) Filed: Jul. 30, 2018

(65) Prior Publication Data

US 2019/0045303 A1 Feb. 7, 2019

(30) Foreign Application Priority Data

Aug. 2, 2017 (CN) ..... 2017 1 0652743

(51) Int. Cl.
*H04R 3/12* (2006.01)
*H04R 1/40* (2006.01)
*H04R 1/32* (2006.01)

(52) U.S. Cl.
CPC ..... *H04R 3/12* (2013.01); *H04R 1/323* (2013.01); *H04R 1/403* (2013.01); *H04R 2430/01* (2013.01)

(58) Field of Classification Search
CPC ..... H04R 2201/401; H04R 2203/12; H04R 2430/20; H04R 5/027; H04R 3/12;
(Continued)

(56) References Cited

U.S. PATENT DOCUMENTS

2011/0211035 A1* 9/2011 Ota ..... H04S 7/303 348/14.01
2013/0077803 A1* 3/2013 Konno ..... H04R 1/323 381/107

(Continued)

FOREIGN PATENT DOCUMENTS

CN 101631032 A 1/2010
CN 103002376 A 3/2013

(Continued)

OTHER PUBLICATIONS

First Office Action issued in corresponding Chinese Patent Application No. 201710652743.0, dated Aug. 13, 2019, 7 pages.

*Primary Examiner* — Norman Yu
(74) *Attorney, Agent, or Firm* — Bayes PLLC

(57) ABSTRACT

The present disclosure discloses a directional propagation method and apparatus for audio signal, a terminal device and a storage medium. The method comprises acquiring a current location of a target user and audio data corresponding to the target user; propagating audio signal corresponding to said audio data towards said current location in a directional manner. By acquiring a current location of a target user in real time, this technical solution dynamically adjusts the audio data corresponding to the target user to be propagated in a directional manner towards said current location, wherein different audio data types (e.g. Chinese language audio or English language audio) may correspond to different target users, in such a way, it can be realized that different audio signals are propagated in a directional manner towards different locations.

9 Claims, 3 Drawing Sheets

(58) Field of Classification Search
CPC ..... H04R 1/403; H04R 2430/01; G10K 2210/3215; H04S 7/302
USPC ..... 381/387, 107, 313, 92
See application file for complete search history.

(56) References Cited

U.S. PATENT DOCUMENTS

| | | | | |
|---|---|---|---|---|
| 2014/0205134 | A1* | 7/2014 | Yagihashi | H04R 3/04 381/387 |
| 2015/0010169 | A1* | 1/2015 | Popova | H04S 7/303 381/107 |
| 2015/0208166 | A1 | 7/2015 | Raghuvanshi et al. | |

FOREIGN PATENT DOCUMENTS

| | | | |
|---|---|---|---|
| CN | 104527516 | A | 4/2015 |
| CN | 105007553 | A | 10/2015 |
| CN | 105323670 | A | 2/2016 |
| CN | 106416304 | A | 2/2017 |
| CN | 106792341 | A | 5/2017 |
| CN | 106973160 | A | 7/2017 |

* cited by examiner

DIRECTIONAL PROPAGATION METHOD AND APPARATUS FOR AUDIO SIGNAL, A TERMINAL DEVICE AND A STORAGE MEDIUM

CROSS REFERENCE TO RELATED APPLICATIONS

This application claims priority of Chinese Patent Application No. 201710652743.0 filed on Aug. 2, 2017, entitled "A Directional Propagation Method And Apparatus For Audio Signal, A Terminal Device And A Storage Medium", which is incorporated herein by reference in its entirety.

TECHNICAL FIELD

The present disclosure relates to the field of telecommunication technology, and in particular relates to a directional propagation method and apparatus for audio signal, a terminal device and a storage medium.

BACKGROUND

Directional audio propagation technology refers to a technology to propagate sound in a directional manner so that only human ears in a predetermined zone can hear the sound. The directional audio propagation technology has a very wide range of application scenes, for example, when a user is watching TV, the TV set can send sound into a predetermined zone by the directional audio propagation technology, and as a result, the user can hear the sound of a TV program once he/she enters the predetermined zone, but the user cannot hear the sound once he/she walks out of the predetermined zone.

However, the directional audio propagation technology in prior art typically can only transmit all the audio signals emitted by a terminal device into the predetermined zone, without discriminating the audio contents, which is an inflexible way of audio propagation. In some special scenes, multiple users in different locations may have mutually different demands for audio contents, for example, the "one screen two displays" function of a TV set is a function that allows one screen to simultaneously play two kinds of images, a TV set with such a function is also called double-channel TV set. Irrespective of whether it is called "one screen two displays" or double-channel TV set, both actually utilize the principle of 3D TV image display, a group of 3D TV manufacturers represented by Kanka call it "double-channel", while another group of 3D TV manufacturers represented by TCL call it "one screen two displays". On the German IFA exhibition of the year 2012, this type of product is exhibited by Samsung, LG and TCL, and attracts interest from many German citizens. In the "one screen two displays" mode or double-channel mode of a TV set, if the user wears no glasses when watching the TV images, there would be a phenomenon of double imaging, this is because two different signal sources are being received and displayed by the TV set. For example, a double-channel TV set can on one hand play a Blu-ray movie and on the other hand display a car racing game of PlayStation 3 at the same time, and two users only need to put on all-left 3D glasses or all-right 3D glasses respectively in order to watch their respective images without mutual influence. Under such circumstances, users wearing different glasses watch different TV programs, but different TV programs correspond to different audio contents (e.g. different audio language types and different audio contents), therefore, the users also need to wear special earphones in order to hear corresponding audio content, otherwise there would be audio interference. However, wearing an earphone not only has a high cost, but also adversely affects the audiovisual experience of the users.

Therefore, how to improve the versatility of directional audio propagation and enhance the audiovisual experience for users is a technical problem that urgently needs to be solved.

SUMMARY

In view of this, the embodiments of the present disclosure provides a directional propagation method and apparatus for audio signal, a terminal device and a storage medium, in order to solve the problem that the directional audio propagation method in prior art is inflexible and causes poor audiovisual experience to users.

According to the first aspect of the present disclosure, a directional propagation method for audio signal provided comprises acquiring a current location of a target user and audio data corresponding to the target user; propagating audio signal corresponding to said audio data towards said current location in a directional manner.

By implementing the method described in the first aspect, different users can preset audio data according to their own demands, and in a specific usage scene, the audio data preset by a target user is acquired, and because the position of the target user may change during the process of listening to audio, a current location of a target user is acquired in real time, and then the audio signal of the audio data corresponding to the target user is propagated towards the current location in a directional manner, wherein different audio data types (e.g. Chinese language audio or English language audio) may correspond to different target users, in such a way, it can be realized that different audio signals are propagated in a directional manner towards different locations, which not only diversifies the versatility of directional audio propagation, so as to fulfill listening preferences of different users of the same terminal device, but also prevents audio interference without the need to wear an earphone, so as to enhance the audiovisual experience of the users.

In combination with the first aspect of the present disclosure, in a first embodiment of the first aspect of the present disclosure, the step of propagating audio signal corresponding to said audio data towards said current location in a directional manner comprises calculating a current distance between a speaker and the target user according to said current location; determining a sound production power for the speaker according to said current distance; propagating audio signal corresponding to said audio data towards said current location in a directional manner with said sound production power.

By executing the above-mentioned step, when propagating audio signal in a directional manner, firstly, a current distance between a speaker of the terminal device and the target user is calculated according to the current location of the target user, then, a sound production power required for the speaker is determined according to the current distance, and the audio content corresponding to the target user is propagated towards the target user's current location in a directional manner by using the sound production power. Herein, when the target user is in different locations, he/she has different distances from the speaker, different sound production powers may be used, and the variation pattern of the sound production power may be specifically configured according to the user's own preference, so that the variation of the sound production power of the speaker is diversified, thereby fulfilling hearing demands of different users in different locations and enhancing the humanization of directional audio propagation and the audiovisual experience of users.

In combination with the first aspect of the present disclosure, in a second embodiment of the first aspect of the present disclosure, the step of determining a sound production power for the speaker according to said current distance comprises increasing the sound production power along with the increase of said current distance.

By executing the above-mentioned step, when propagating audio signal in a directional manner, if target users are in different locations, they may have different distances from the speaker, and in order to fulfill hearing demands of different target users, different sound production powers need to be used. For example, when the current distance is relatively large, the sound production power of the speaker may be relatively high, so that the target user can hear a suitable audio volume; on the contrary, when the current distance is relatively small, the sound production power of the speaker may be properly lowered by a particular adjustment amount that may be predetermined according to actual demands of the user, and as a result, not only the target user can hear audio in a suitable audio volume with improved audiovisual experience, but also the energy consumption of the terminal device can be saved so as to achieve an effect of energy saving and environment protection.

In combination with the first aspect of the present disclosure, in a third embodiment of the first aspect of the present disclosure, the step of propagating audio signal corresponding to said audio data towards said current location in a directional manner comprises calculating a current angle between a speaker and the target user according to said current location; obtaining a current propagation range by using said current angle plus and minus a predetermined angle; propagating audio signal corresponding to said audio data into said current propagation range in a directional manner.

By executing the above-mentioned step, when propagating audio signal in a directional manner, firstly, a current angle between a speaker of the terminal device and the target user is calculated according to the current location of the target user, then a current propagation range is obtained according to the current angle, in particular, the current propagation range is calculated by the current angle plus and minus a predetermined angle, and then the audio signal corresponding to the target user is propagated into the current propagation range in a directional manner, in such a way, it can be ensured that the target user can always hear the related audio when he/she is within the current propagation range. The predetermined angle may be set according to the user's preference, for example, when there are more users listening to the same terminal device, the predetermined angle may be set to be smaller, so as to prevent sound interference; naturally, when there is only one user using the terminal device, the predetermined angle may be set to be sufficiently large, so as to fulfill the listening preference of this user. In such a way, the current propagation range is configured flexibly, which not only increase the versatility and intelligential level of directional audio propagation, but also widens the application scope of directional audio propagation.

Furthermore, the second aspect of the present disclosure provides a directional propagation apparatus for audio signal, used on a terminal device such as a computer or a TV set, and the directional propagation apparatus for audio signal comprises modules or units for executing the directional propagation method for audio signal according to the above-mentioned first aspect or any embodiment of the first aspect.

For instance, the apparatus comprises an acquiring module, for acquiring a current location of a target user and audio data corresponding to the target user; a directional propagation module, for propagating audio signal corresponding to said audio data towards said current location in a directional manner.

By implementing the above-mentioned directional propagation apparatus for audio signal, different users can preset audio data according to their own demands, and in a specific usage scene, the audio data preset by a target user is acquired, and because the position of the target user may change during the process of listening to audio, a current location of a target user is acquired in real time, and then the audio signal of the audio data corresponding to the target user is propagated towards the current location in a directional manner, wherein different audio data types (e.g. Chinese language audio or English language audio) may correspond to different target users, in such a way, it can be realized that different audio signals are propagated in a directional manner towards different locations, which not only diversifies the versatility of directional audio propagation, so as to fulfill listening preferences of different users of the same terminal device, but also prevents audio interference without the need to wear an earphone, so as to enhance the audiovisual experience of the users.

In combination with the second aspect of the present disclosure, in a first embodiment of the second aspect of the present disclosure, the directional propagation module comprises a first calculation unit, for calculating a current distance between a speaker and the target user according to said current location; a determining unit, for determining a sound production power for the speaker according to said current distance; a first propagation unit, for propagating audio signal corresponding to said audio data towards said current location in a directional manner with said sound production power.

By implementing the above-mentioned directional propagation apparatus for audio signal, when propagating audio signal in a directional manner, firstly, a current distance between a speaker of the terminal device and the target user is calculated according to the current location of the target user, then, a sound production power required for the speaker is determined according to the current distance, and the audio content corresponding to the target user is propagated towards the target user's current location in a directional manner by using the sound production power. Herein, when the target user is in different locations, he/she has different distances from the speaker, different sound production powers may be used, and the variation pattern of the sound production power may be specifically configured according to the user's own preference, so that the variation of the sound production power of the speaker is diversified, thereby fulfilling hearing demands of different users in different locations and enhancing the humanization of directional audio propagation and the audiovisual experience of users.

In combination with the second aspect of the present disclosure, in a second embodiment of the second aspect of the present disclosure, determining a sound production power for the speaker according to said current distance comprises increasing the sound production power along with the increase of said current distance.

By implementing the above-mentioned directional propagation apparatus for audio signal, when propagating audio signal in a directional manner, if target users are in different locations, they may have different distances from the speaker, and in order to fulfill hearing demands of different target users, different sound production powers need to be used. For example, when the current distance is relatively large, the sound production power of the speaker may be relatively high, so that the target user can hear a suitable audio volume; on the contrary, when the current distance is relatively small, the sound production power of the speaker may be properly lowered by a particular adjustment amount that may be predetermined according to actual demands of the user, and as a result, not only the target user can hear audio in a suitable audio volume with improved audiovisual experience, but also the energy consumption of the terminal device can be saved so as to achieve an effect of energy saving and environment protection.

In combination with the second aspect of the present disclosure, in a third embodiment of the second aspect of the present disclosure, the directional propagation module comprises a second calculation unit, for calculating a current angle between a speaker and the target user according to said current location; a third calculation unit, for obtaining a current propagation range by using said current angle plus and minus a predetermined angle; a second propagation unit, for propagating audio signal corresponding to said audio data into said current propagation range in a directional manner.

By implementing the above-mentioned directional propagation apparatus for audio signal, when propagating audio signal in a directional manner, firstly, a current angle between a speaker of the terminal device and the target user is calculated according to the current location of the target user, then a current propagation range is obtained according to the current angle, in particular, the current propagation range is calculated by the current angle plus and minus a predetermined angle, and then the audio signal corresponding to the target user is propagated into the current propagation range in a directional manner, in such a way, it can be ensured that the target user can always hear the related audio when he/she is within the current propagation range. The predetermined angle may be set according to the user's preference, for example, when there are more users listening to the same terminal device, the predetermined angle may be set to be smaller, so as to prevent sound interference; naturally, when there is only one user using the terminal device, the predetermined angle may be set to be sufficiently large, so as to fulfill the listening preference of this user. In such a way, the current propagation range is configured flexibly, which not only increase the versatility and intelligential level of directional audio propagation, but also widens the application scope of directional audio propagation.

The modules or units included in the directional propagation apparatus for audio signal are not limited to the naming above.

These aspects of the present disclosure are made clearer and easier to understand in the following description of the embodiments.

According to the third aspect of the present disclosure, a terminal device provided comprises the directional propagation apparatus for audio signal according to the second aspect of the present disclosure or any embodiment of the second aspect, and therefore has all the beneficial effects of the directional propagation apparatus for audio signal described in the second aspect of the present disclosure or in any embodiment of the second aspect, which are not repeatedly described herein.

According to the fourth aspect of the present disclosure, a computer readable storage medium is provided, wherein, the computer readable storage medium stores computer instructions for causing a computer to execute the directional propagation method for audio signal according to the first aspect of the present disclosure or any embodiment of the first aspect.

BRIEF DESCRIPTION OF THE DRAWINGS

The features and advantages of the present disclosure will be understood more clearly by referring to the accompanying drawings, and the accompanying drawings are illustrative and should not be interpreted as any limitation to the present disclosure. In the drawings.

DETAILED DESCRIPTION

In order for the objectives, features and advantages of the present disclosure to be more clearly understood, hereinafter, a clear and complete description of the technical solution in embodiments of the present disclosure is provided in combination with the accompanying drawings of the embodiments of the present disclosure. Apparently, the embodiments described below are part of, but not all of, the embodiments of the present disclosure. All the other embodiments, obtained by a person skilled in the art on the basis of the embodiments described in the present disclosure without expenditure of creative labor, belong to the protection scope of the present disclosure.

Figure 1:
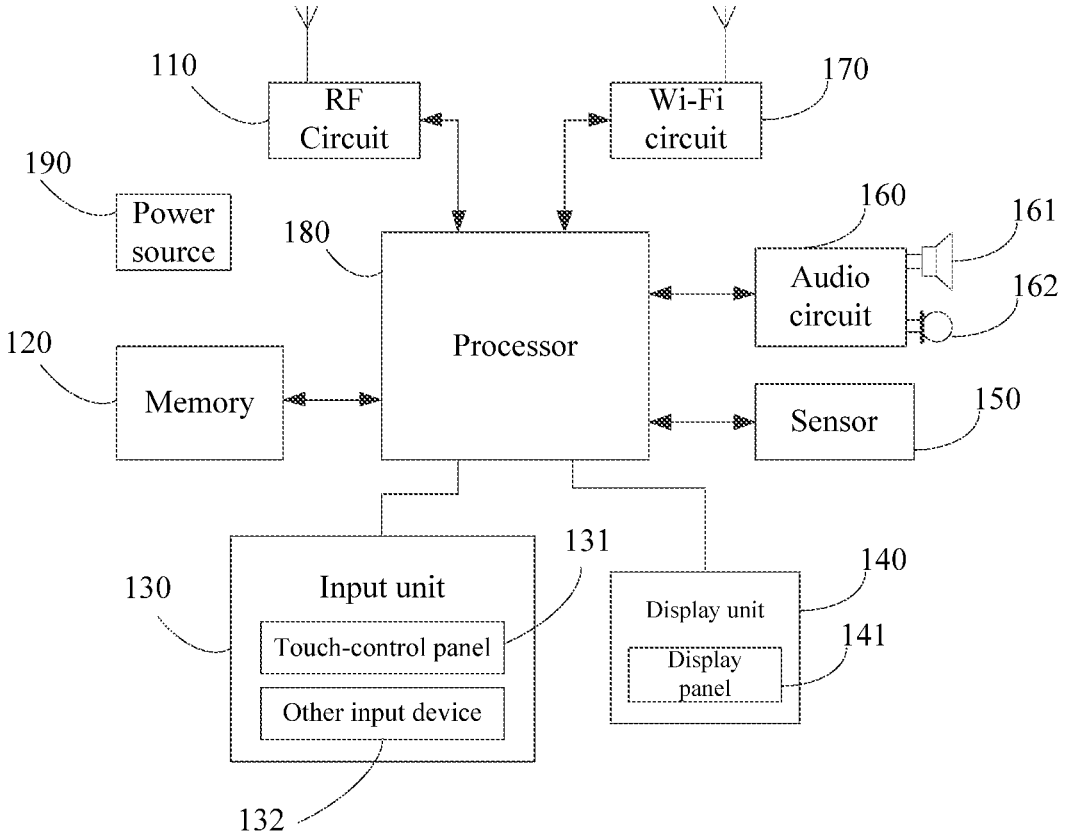
FIG. 1 shows a structural diagram of a cellphone in the embodiments of the present disclosure.

As shown in FIG. 1, it is an application scene schematic diagram of the embodiments of the present disclosure. The mobile terminal is a mobile device such as a cellphone or a tablet computer. A cellphone is taken as an example of the mobile terminal, and a partial structural block diagram of the cellphone is shown in FIG. 1, the cellphone comprises a radio-frequency circuit 110, a memory 120, an input unit 130, a display unit 140, a sensor 150, an audio circuit 160, a wireless module 170, a processor 180, a power source 190, etc. And a person skilled in the art can understand that, the cellphone structure shown in FIG. 1 does not constitute a limitation to the cellphone, the cellphone may comprise more components or less components than what is shown in this Figure, or some components may be combined, or there is a different layout of the components.

Wherein, the RF circuit 110 is used for receiving and sending signals in a process of information transmission or voice call. The memory 120 is used for storing software programs and modules, the processor 180 executes various application functions and data processing of the cellphone by running the software programs and modules stored in the memory 120. The input unit 130 may comprise a touch-control panel 131 or other input devices 132. Said other input devices 132 may include, but not limited to, one or more selected from a physical keyboard, a function button, a mouse, a joystick. The display unit 140 is used for displaying information inputted by a user, or information to be provided to a user, or various menus of the cellphone. The display unit 140 may comprise a display panel 141. The touch-control panel 131 may cover the display panel 141, and when the touch-control panel 131 detects a touch operation on it or in the proximity of it, the touch-control panel 131 transmits signal to the processor 180 so as to determine a type of the touch incident, and then the processor 180 provides a corresponding visual output on the display panel 141 according to the type of the touch incident.

The cellphone may also comprise at least one kind of sensor 150, such as an optical sensor, a motion sensor or other sensors. The optical sensor may comprise an environment light sensor and a proximity sensor, wherein the environment light sensor can adjust the luminance of the display panel 141 according to the brightness of environment light, and the proximity sensor can turn off the display panel 141 and/or the backlight when the cellphone is moved into proximity of the user's ear. The optical sensor in this embodiment may be provided on a casing at a front side or a back side of the cellphone, for detecting a shading area when the use holds the cellphone. Also, the cellphone may also comprise a pressure sensor provided on a casing at a front side or a back side of the cellphone, for determining the shading area when the use holds the cellphone, by detecting a pressure. In addition, the cellphone may also be equipped with other sensors such as a gyroscope, a barometer, a hygrometer, a thermometer, an infrared ray sensor, which are not cumbersomely described herein.

The audio circuit 160, together with a speaker 161 and a sound receiver 162, can provide an audio interface between the user and the cellphone. The wireless module 170 may be a Wi-Fi module, which provides wireless internet access service to the user.

The processor 180 is a control center of the cellphone, which interconnects the respective components of the entire cellphone by using various interfaces and wires and executes various functions and data processing of the cellphone by running or executing the software programs and/or modules stored in the memory 120 as well as calling the data stored in the memory 120, so as to monitor the cellphone as a whole. Optionally, the processor 180 may comprise one or more processing units. Also, the cellphone comprises the power source 190 for supplying power to the respective components, and the power source 190 is logically connected to the processor 180 through a power management system, so as to realize functions such as charge and discharge management, energy consumption management, etc. by means of the power management system.

Although not shown, the cellphone may also comprise a camera, a Bluetooth module, etc., which are not cumbersomely described herein.

Figure 2:
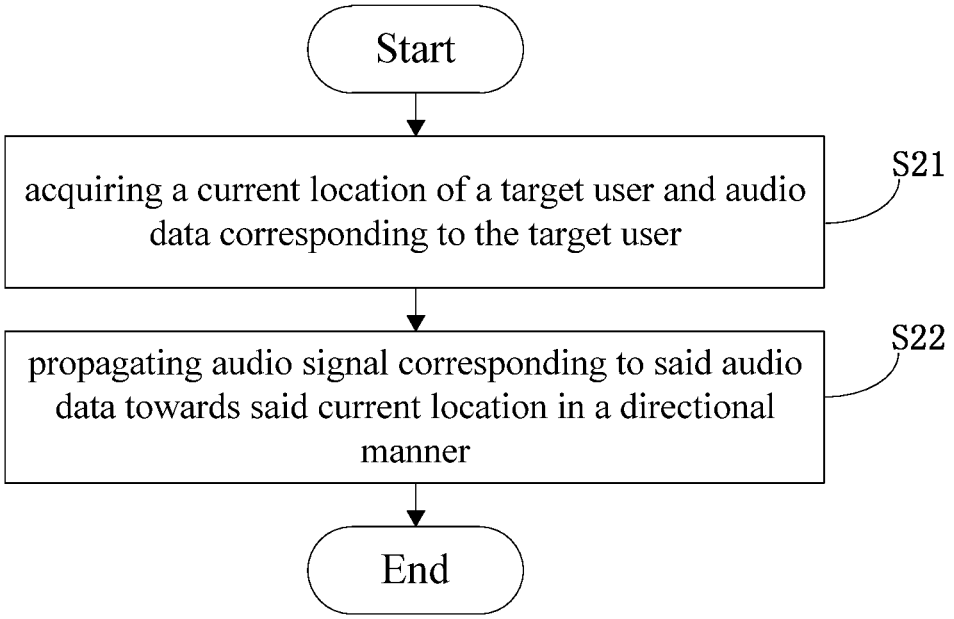
FIG. 2 shows a flow chart of a directional propagation method for audio signal according to the embodiments of the present disclosure.

Referring to FIG. 2, the embodiments of the present disclosure provides a directional propagation method for audio signal, which is used on a terminal device such as a computer or a TV set. The method comprises:

S21: acquiring a current location of a target user and audio data corresponding to the target user. Different users can preset audio data (including audio language type, audio content, etc.) according to their own demands, and in a specific usage scene, the audio data preseted by a target user is acquired, and because the position of the target user may change during the process of listening to audio, a current location of a target user is detected in real time, in particular, when listening to a program on a "one screen two displays" terminal device, for example, the terminal device may acquire the location of each pair of glasses (each target user corresponds to a pair of glasses, each pair of glasses has an identification and has corresponding TV program or contents) by means of a camera (image recognition) or wireless communication technology (such as infrared, WiFi, Bluetooth, GPS), i.e. acquiring the current location of the target user, and then the terminal device acquires audio data of the TV program corresponding to the respective pairs of glasses.

S22: propagating audio signal corresponding to said audio data towards said current location in a directional manner. After the current location of the target user and corresponding audio data are acquired, the audio signal of this audio data is propagated towards the current location in a directional manner, wherein different audio data types (e.g. Chinese language audio or English language audio) may correspond to different target users, and the dynamic change of the user's location is detected in real time, so as to capture the changing process of the current location of the target user, for dynamically adjusting the direction of directional audio signal propagation. In such a way, it can be realized that different audio signals are propagated in a directional manner towards different locations, which not only diversifies the versatility of directional audio propagation, so as to fulfill listening preferences of different users of the same terminal device, but also prevents audio interference without the need to wear an earphone, so as to enhance the audiovisual experience of the users.

Optionally, Step S22 may comprise: calculating a current distance between a speaker and the target user according to said current location; determining a sound production power for the speaker according to said current distance; propagating audio signal corresponding to said audio data towards said current location in a directional manner with said sound production power. In particular, when propagating audio signal in a directional manner, firstly, a current distance between a speaker of the terminal device and the target user is calculated according to the current location of the target user, then, a sound production power required for the speaker is determined according to the current distance, and the audio content corresponding to the target user is propagated towards the target user's current location in a directional manner by using the sound production power. Herein, when the target user is in different locations, he/she has different distances from the speaker, different sound production powers may be used, and the variation pattern of the sound production power may be specifically configured according to the user's own preference, so that the variation of the sound production power of the speaker is diversified, thereby fulfilling hearing demands of different users in different locations and enhancing the humanization of directional audio propagation and the audiovisual experience of users.

Optionally, the operation of determining a sound production power for the speaker according to said current distance comprises increasing the sound production power along with the increase of said current distance. In particular, when propagating audio signal in a directional manner, if target users are in different locations, they may have different distances from the speaker, and in order to fulfill hearing demands of different target users, different sound production powers need to be used. For example, when the current distance is relatively large, the sound production power of the speaker may be relatively high, so that the target user can hear a suitable audio volume; on the contrary, when the current distance is relatively small, the sound production power of the speaker may be properly lowered by a particular adjustment amount that may be predetermined according to actual demands of the user, and as a result, not only the target user can hear audio in a suitable audio volume with improved audiovisual experience, but also the energy consumption of the terminal device can be saved so as to achieve an effect of energy saving and environment protection.

Optionally, Step S22 may also comprise: calculating a current angle between a speaker and the target user according to said current location; obtaining a current propagation range by using said current angle plus and minus a predetermined angle; propagating audio signal corresponding to said audio data into said current propagation range in a directional manner. In particular, when propagating audio signal in a directional manner, firstly, a current angle between a speaker of the terminal device and the target user is calculated according to the current location of the target user, then a current propagation range is obtained according to the current angle, specifically, the current propagation range is calculated by the current angle plus and minus a predetermined angle, and then the audio signal corresponding to the target user is propagated into the current propagation range in a directional manner, in such a way, it can be ensured that the target user can always hear the related audio when he/she is within the current propagation range. The predetermined angle may be set according to the user's preference, for example, when there are more users listening to the same terminal device, the predetermined angle may be set to be smaller, so as to prevent sound interference; naturally, when there is only one user using the terminal device, the predetermined angle may be set to be sufficiently large, so as to fulfill the listening preference of this user. In such a way, the current propagation range is configured flexibly, which not only increase the versatility and intelligential level of directional audio propagation, but also widens the application scope of directional audio propagation.

By using the directional propagation method for audio signal provided in this embodiment, different users can preset audio data according to their own demands, and in a specific usage scene, the audio data preseted by a target user is acquired, and because the position of the target user may change during the process of listening to audio, a current location of a target user is acquired in real time, and then the audio signal of the audio data corresponding to the target user is propagated towards the current location in a directional manner, wherein different audio data types (e.g. Chinese language audio or English language audio) may correspond to different target users, in such a way, it can be realized that different audio signals are propagated in a directional manner towards different locations, which not only diversifies the versatility of directional audio propagation, so as to fulfill listening preferences of different users of the same terminal device, but also prevents audio interference without the need to wear an earphone, so as to enhance the audiovisual experience of the users.

Figure 3:
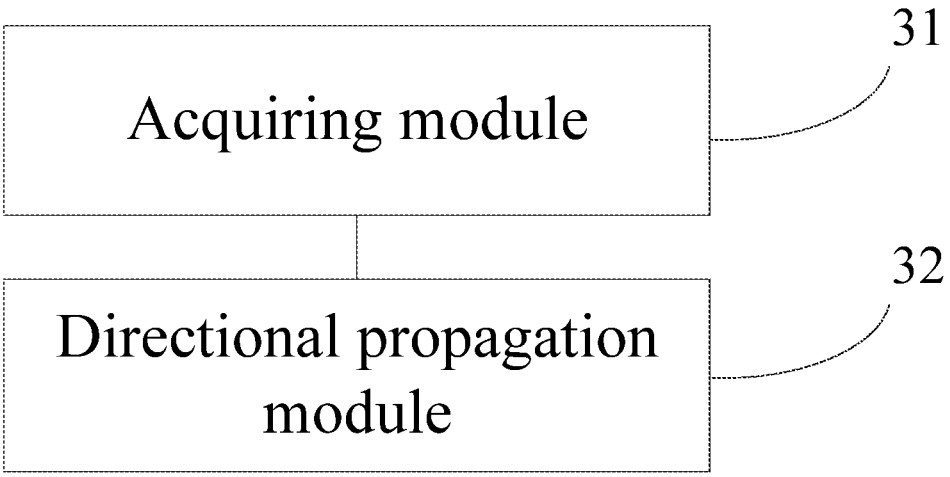
FIG. 3 shows a structural schematic diagram of a directional propagation apparatus for audio signal according to the embodiments of the present disclosure.

Referring to FIG. 3, which is a structural schematic diagram of a directional propagation apparatus for audio signal provided by the embodiments of the present disclosure, the apparatus is used on a terminal device such as a computer or a TV set, and the apparatus comprises:

an acquiring module 31, for acquiring a current location of a target user and audio data corresponding to the target user. Detailed content thereof can refer to the Step S21 in the embodiment described above.

a directional propagation module 32, for propagating audio signal corresponding to said audio data towards said current location in a directional manner. Detailed content thereof can refer to the Step S22 in the embodiment described above.

Figure 4:
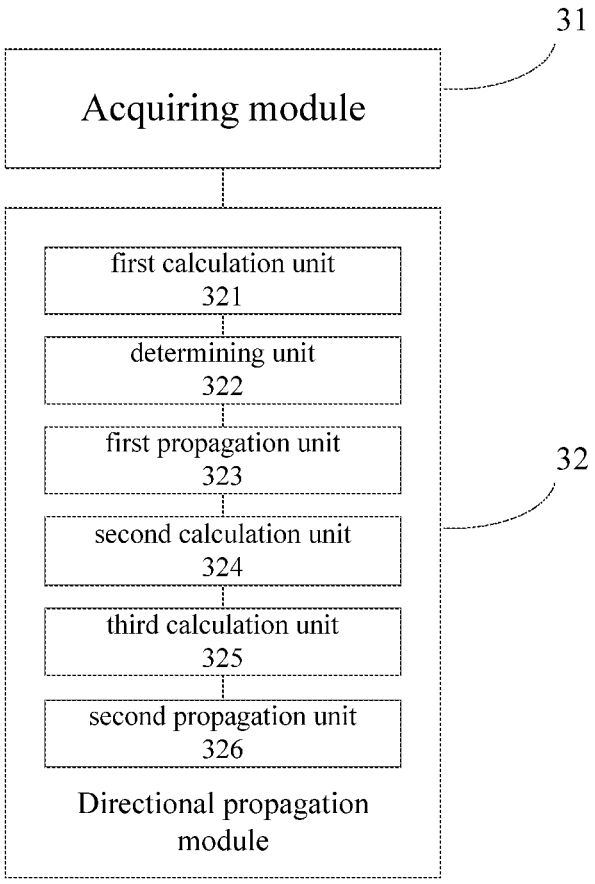
FIG. 4 shows another structural schematic diagram of a directional propagation apparatus for audio signal according to the embodiments of the present disclosure.

Optionally, in some embodiments of the present disclosure, as shown in FIG. 4, the directional propagation module 32 comprises: a first calculation unit 321, for calculating a current distance between a speaker and the target user according to said current location; a determining unit 322, for determining a sound production power for the speaker according to said current distance; a first propagation unit 323, for propagating audio signal corresponding to said audio data towards said current location in a directional manner with said sound production power. Detailed content thereof can refer to the related detailed description in the embodiment described above.

Optionally, in some embodiments of the present disclosure, said determining a sound production power for the speaker according to said current distance comprises increasing the sound production power along with the increase of said current distance. Detailed content thereof can refer to the related detailed description in the embodiment described above.

Optionally, in some embodiments of the present disclosure, as shown in FIG. 4, the directional propagation module 32 comprises: a second calculation unit 324, for calculating a current angle between a speaker and the target user according to said current location; a third calculation unit 325, for obtaining a current propagation range by using said current angle plus and minus a predetermined angle; a second propagation unit 326, for propagating audio signal corresponding to said audio data into said current propagation range in a directional manner. Detailed content thereof can refer to the related detailed description in the embodiment described above.

By using the above-mentioned directional propagation apparatus for audio signal, different users can preset audio data according to their own demands, and in a specific usage scene, the audio data preseted by a target user is acquired, and because the position of the target user may change during the process of listening to audio, a current location of a target user is acquired in real time, and then the audio signal of the audio data corresponding to the target user is propagated towards the current location in a directional manner, wherein different audio data types (e.g. Chinese language audio or English language audio) may correspond to different target users, in such a way, it can be realized that different audio signals are propagated in a directional manner towards different locations, which not only diversifies the versatility of directional audio propagation, so as to fulfill listening preferences of different users of the same terminal device, but also prevents audio interference without the need to wear an earphone, so as to enhance the audiovisual experience of the users.

The embodiments of the present disclosure also provide a terminal device that comprises the directional propagation apparatus for audio signal according to any one of the above-mentioned embodiments.

Hereinafter, a smartphone is taken as an example to illustrate the terminal device of the present disclosure.

Figure 5:
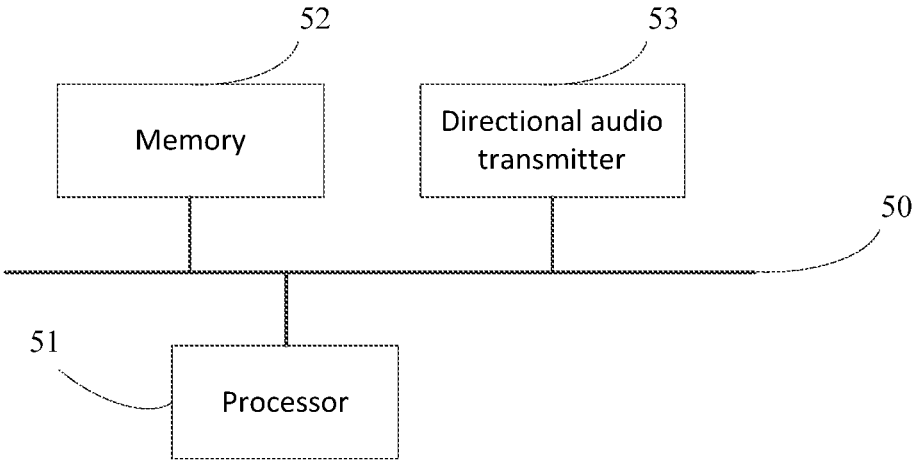
FIG. 5 shows a structural schematic diagram of a terminal device according to the embodiments of the present disclosure.

As shown in FIG. 5, accordingly, the terminal device provided by the embodiments of the present disclosure comprises at least one processor 51, a memory 52 and a directional audio transmitter 53. In FIG. 5, one processor is shown as an example. The processor 51, the memory 52 and the directional audio transmitter 53 are interconnected by a bus 50, the memory 52 stores instructions that can be executed by the at least one processor 51, and execution of the instructions by the at least one processor 51 causes the at least one processor to execute the following method:

acquiring a current location of a target user and audio data corresponding to the target user;

propagating audio signal corresponding to said audio data towards said current location in a directional manner.

Optionally, in some embodiments of the present disclosure, the operation of propagating audio signal corresponding to said audio data towards said current location in a directional manner comprises: calculating a current distance between a speaker and the target user according to said current location; determining a sound production power for the speaker according to said current distance; propagating audio signal corresponding to said audio data towards said current location in a directional manner with said sound production power.

Optionally, in some embodiments of the present disclosure, the operation of determining a sound production power for the speaker according to said current distance comprises increasing the sound production power along with the increase of said current distance.

Optionally, in some embodiments of the present disclosure, the operation of propagating audio signal corresponding to said audio data towards said current location in a directional manner comprises calculating a current angle between a speaker and the target user according to said current location; obtaining a current propagation range by using said current angle plus and minus a predetermined angle; propagating audio signal corresponding to said audio data into said current propagation range in a directional manner.

The related description thereof can be understood by accordingly referring to the description and effects related to the corresponding steps of FIG. 2.

By using the terminal device provided by the above-mentioned embodiment, different users can preset audio data according to their own demands, and in a specific usage scene, the audio data preseted by a target user is acquired, and because the position of the target user may change during the process of listening to audio, a current location of a target user is acquired in real time, and then the audio signal of the audio data corresponding to the target user is propagated towards the current location in a directional manner, wherein different audio data types (e.g. Chinese language audio or English language audio) may correspond to different target users, in such a way, it can be realized that different audio signals are propagated in a directional manner towards different locations, which not only diversifies the versatility of directional audio propagation, so as to fulfill listening preferences of different users of the same terminal device, but also prevents audio interference without the need to wear an earphone, so as to enhance the audio-visual experience of the users.

The embodiments of the present disclosure also provide a computer readable storage medium, the computer readable storage medium stores computer executable instructions, the computer executable instructions can execute all the steps, or part of the steps, of the method of the above-mentioned embodiments. Wherein, the storage medium may be a magnetic disk, an optical Disk, a Read-Only Memory (ROM), a Random Access Memory (RAM), a Flash Memory, a Hard Disk Drive (HDD) or a Solid-State Drive (SSD); the storage medium may also comprise a combination of the aforementioned types of memory devices.

Although some embodiments of the present disclosure are described in combination with the accompanying drawings, a person skilled in the art can make various changes and modifications without departing from the essence and scope of the present disclosure, and these changes and modifications should all be embraced in the scope defined by the appended Claims.

It will be apparent to those skilled in the art that various modifications and variations can be made to the disclosed system and related methods. Other embodiments will be apparent to those skilled in the art from consideration of the specification and practice of the disclosed system and related methods.

It is intended that the specification and examples be considered as exemplary only, with a true scope being indicated by the following claims and their equivalents.

What is claimed is:

1. A directional propagation method for audio signal, comprising:

acquiring a current location of each of a plurality of target users and audio data corresponding to the each of the plurality of target users; and propagating audio signal corresponding to said audio data towards the each of the plurality of target users at said current location in a directional manner, comprising:

calculating a current angle between a speaker and the each of the plurality of target users according to said current location;

obtaining a current propagation range by using said current angle plus and minus a predetermined angle; and propagating the audio signal corresponding to said audio data into said current propagation range in a directional manner, wherein the predetermined angle increases as a number of the plurality of target users decreases and decreases as the number of the plurality of target users increases, and a type of audio data propagated towards the each of the plurality of target users is different from one another.

2. The directional propagation method of claim 1, wherein propagating audio signal corresponding to said audio data towards the each of the plurality of target users at said current location in a directional manner comprises:

calculating a current distance between a speaker and the each of the plurality of target users according to said current location;

determining a sound production power for the speaker according to said current distance; and propagating the audio signal corresponding to said audio data towards the each of the plurality of target users at said current location in a directional manner with said sound production power.

3. The directional propagation method of claim 2, wherein determining a sound production power for the speaker according to said current distance comprises:

increasing the sound production power along with an increase of said current distance.

4. A terminal device, comprising:

at least one processor; and a memory communicably connected with the at least one processor for storing instructions executable by the at least one processor, wherein execution of the instructions by the at least one processor causes the at least one processor to:

acquire a current location of each of a plurality of target users and audio data corresponding to the each of the plurality of target users; and propagate audio signal corresponding to said audio data towards the each of the plurality of target users at said current location in a directional manner, to propagate the audio signal being performed by:

calculating a current angle between a speaker and the each of the plurality of target users according to said current location;

obtaining a current propagation range by using said current angle plus and minus a predetermined angle; and propagating the audio signal corresponding to said audio data into said current propagation range in a directional manner, wherein the predetermined angle increases as a number of the plurality of target users decreases and decreases as the number of the plurality of target users increases, and a type of audio data propagated towards the each of the plurality of target users is different from one another.

5. The terminal device of claim 4, wherein to propagate audio signal corresponding to said audio data towards the each of the plurality of target users at said current location in a directional manner is performed by:

calculating a current distance between a speaker and the each of the plurality of target users according to said current location;

determining a sound production power for the speaker according to said current distance; and propagating the audio signal corresponding to said audio data towards the each of the plurality of target users at said current location in a directional manner with said sound production power.

6. The terminal device of claim 5, wherein determining a sound production power for the speaker according to said current distance comprises:

increasing the sound production power along with an increase of said current distance.

7. A computer readable storage medium, wherein, the computer readable storage medium stores computer instructions for causing a computer to:

acquire a current location of each of a plurality of target users and audio data corresponding to the each of the plurality of target users; and propagate audio signal corresponding to said audio data towards the each one of the plurality of target users at said current location in a directional manner, to propagate the audio signal being performed by:

calculating a current angle between a speaker and the each of the plurality of target users according to said current location;

obtaining a current propagation range by using said current angle plus and minus a predetermined angle; and propagating the audio signal corresponding to said audio data into said current propagation range in a directional manner, wherein the predetermined angle increases as a number of the plurality of target users decreases and decreases as the number of the plurality of target users increases, and a type of audio data propagated towards the each of the plurality of target users is different from one another.

8. The computer readable storage medium of claim 7, wherein to propagate audio signal corresponding to said audio data towards the each of the plurality of target users at said current location in a directional manner is performed by:

calculating a current distance between a speaker and the each of the plurality of target users according to said current location;

determining a sound production power for the speaker according to said current distance; and propagating the audio signal corresponding to said audio data towards the each of the plurality of target users at said current location in a directional manner with said sound production power.

9. The computer readable storage medium of claim 8, wherein determining a sound production power for the speaker according to said current distance comprises:

increasing the sound production power along with an increase of said current distance.

* * * * *